US008348647B2

(12) United States Patent
Kiyokawa et al.

(10) Patent No.: US 8,348,647 B2
(45) Date of Patent: Jan. 8, 2013

(54) SCROLL TYPE COMPRESSOR INCLUDING A SUCTION PIPE HAVING IRON PORTION AND COPPER PORTION

(75) Inventors: Yasunori Kiyokawa, Moriguchi (JP); Satoshi Iitsuka, Moriguchi (JP); Kazuyoshi Sugimoto, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 342 days.

(21) Appl. No.: 12/709,051

(22) Filed: Feb. 19, 2010

(65) Prior Publication Data

US 2010/0215533 A1 Aug. 26, 2010

(30) Foreign Application Priority Data

Feb. 20, 2009 (JP) ..... 2009-037446

(51) Int. Cl.
*F01C 1/02* (2006.01)
*F03C 2/00* (2006.01)

(52) U.S. Cl. ..... 418/55.1; 418/152; 418/178; 418/179; 285/24; 285/27; 285/330

(58) Field of Classification Search ..... 418/55.1–55.6, 418/57, 152, 178, 179; 285/24, 27, 330, 285/332, 55
See application file for complete search history.

(56) References Cited

U.S. PATENT DOCUMENTS

| | | | | |
|---|---|---|---|---|
| 4,518,324 | A * | 5/1985 | Mizuno et al. | 418/55.4 |
| 4,702,683 | A * | 10/1987 | Inaba et al. | 418/55.6 |
| 5,249,941 | A * | 10/1993 | Shibamoto | 418/55.5 |
| 5,511,831 | A * | 4/1996 | Barton | 285/382 |
| 6,186,556 | B1 * | 2/2001 | Masuyama et al. | 285/24 |
| 2007/0145739 | A1 * | 6/2007 | Haberl | 285/253 |

FOREIGN PATENT DOCUMENTS

| | | |
|---|---|---|
| JP | 62-218678 | 9/1987 |
| JP | 08319972 A * | 12/1996 |

* cited by examiner

*Primary Examiner* — Theresa Trieu
(74) *Attorney, Agent, or Firm* — McDermott Will & Emery LLP

(57) ABSTRACT

A scroll type compressor includes a fixed scroll having a suction opening, a movable scroll, a hermetically sealed container having an upper cap, and a suction pipe that penetrates through the upper cap and is engagedly fitted through an O ring in the suction opening of the fixed scroll at a lower portion thereof. The upper cap includes a pipe stand formed of iron at a suction-pipe penetrating portion thereof. The suction pipe comprises an iron lower suction member that is engagedly fitted in the suction opening of the fixed scroll and an O-ring groove in which the O ring is fitted, and a copper upper suction member that is joined to the lower suction member by brazing and engagedly fitted in the pipe stand. The upper suction member and the pipe stand are joined to each other by brazing.

10 Claims, 4 Drawing Sheets

SCROLL TYPE COMPRESSOR INCLUDING A SUCTION PIPE HAVING IRON PORTION AND COPPER PORTION

INCORPORATION BY REFERENCE

The present application claims priority under 35 U.S.C. §119 to Japanese Patent Application No. 2009-037446 filed on Feb. 20, 2009. The content of the application is incorporated herein by reference in its entirety.

BACKGROUND OF THE INVENTION

1. Field of the Invention

The present invention relates to a scroll type compressor having a structure that a lower end portion of a suction pipe is joined to a suction opening of a fixed scroll through an O ring.

2. Description of the Related Art

There is generally known a scroll type compressor having a fixed scroll, a movable scroll, a hermetically sealed container in which the fixed scroll and the movable scroll are mounted, and a suction pipe which penetrates through an upper cap of the hermetically sealed container and whose lower end portion is fitted in a suction opening provided to the fixed scroll through an O ring. In this type of compressor, a copper pipe is used as the suction pipe in some cases, the thickness of the suction pipe is not so large, and thus an O-ring groove in which the O ring is engagedly fitted is not formed on the outer periphery of the copper pipe, but formed on the inner periphery of the suction opening of the fixed scroll. In this construction, it is difficult to process the O-ring groove, and the manufacturing cost rises up. On the other hand, when the suction pipe is formed of an iron pipe, the O-ring groove in which the O ring is engagedly fitted is formed on the outer periphery of the iron pipe (for example, JP-A-62-218678).

When the suction pipe is formed of iron, the groove processing of the O ring groove is easy. However, it is necessary to braze a refrigerant pipe (generally, copper pipe) to the iron pipe, and thus a brazing work is difficult. Furthermore, when the pipe stand of the upper cap and the iron pipe are welded to each other, the iron pipe is heated and thus heat is transferred to the O ring.

SUMMARY OF THE INVENTION

The present invention has an object to solve the above problem of the related art, and provide a scroll type compressor having a structure that joint of a refrigerant pipe is easy and heat transfer to an O ring can be suppressed when a pipe stand and an iron pipe are joined to each other.

In order to attain the above object, there is provided a scroll type compressor comprising: a fixed scroll having a suction opening; a movable scroll; a hermetically sealed container having an upper cap in which the fixed scroll and the movable scroll are mounted; and a suction pipe that penetrates through the upper cap and is engagedly fitted through an O ring in the suction opening of the fixed scroll at a lower portion thereof, wherein the upper cap is provided with a pipe stand formed of iron at a suction-pipe penetrating portion thereof, and the suction pipe comprises an iron lower suction member that is engagedly fitted in the suction opening of the fixed scroll and an O-ring groove in which the O ring is fitted, and a copper upper suction member that is joined to the lower suction member by brazing and engagedly fitted in the pipe stand, the upper suction member and the pipe stand being joined to each other by brazing.

According to the present invention, the suction pipe comprises the upper suction member and the lower suction member, and the lower suction member is formed of iron. Therefore, the thickness of the lower suction member can be increased. Therefore, the O-ring groove in which the O ring is fitted can be processed on the outer periphery of the lower suction member. Accordingly, the manufacturing cost can be more reduced as compared with the conventional technique. Furthermore, the upper suction member is formed of copper, and thus a refrigerant pipe (copper pipe) can be joined to the upper suction member by brazing, and the joint work can be simply performed. In the case of brazing, unlike general welding, increase of the temperature of the suction member is suppressed, and the heats transfer to the O ring can be suppressed.

In this case, the upper suction member may be configured to be reduced in diameter at the lower end thereof, and the diameter-reduced portion of the upper suction member may be joined to the inner periphery of the an upper end portion of the lower suction member by brazing.

According to this construction, the joint portion is reduced in diameter, and also the diameter-reduced portion is designed in a spigot structure with respect to the inner periphery of the upper end portion of the lower suction member 31*a*, and thus the outer diameter of the suction pipe can be reduced. Accordingly, the suction pipe can be easily fitted in the pipe stand.

In this case, the maximum outer diameter of the suction pipe may be set to be slightly smaller than the inner diameter of the pipe stand so that the suction pipe can pass through the inner periphery of the pipe stand. Furthermore, the upper suction member and the lower suction member may be set to be coincident with each other in maximum diameter.

According to this construction, even after the upper cap is welded, the suction pipe can be passed through the pipe stand and fitted in the suction opening. Therefore, the suction pipe can be afterwards mounted.

DETAILED DESCRIPTION OF THE PREFERRED EMBODIMENT

A preferred embodiment according to the present invention will be described hereunder with reference to the accompanying drawings.

Figure 1:
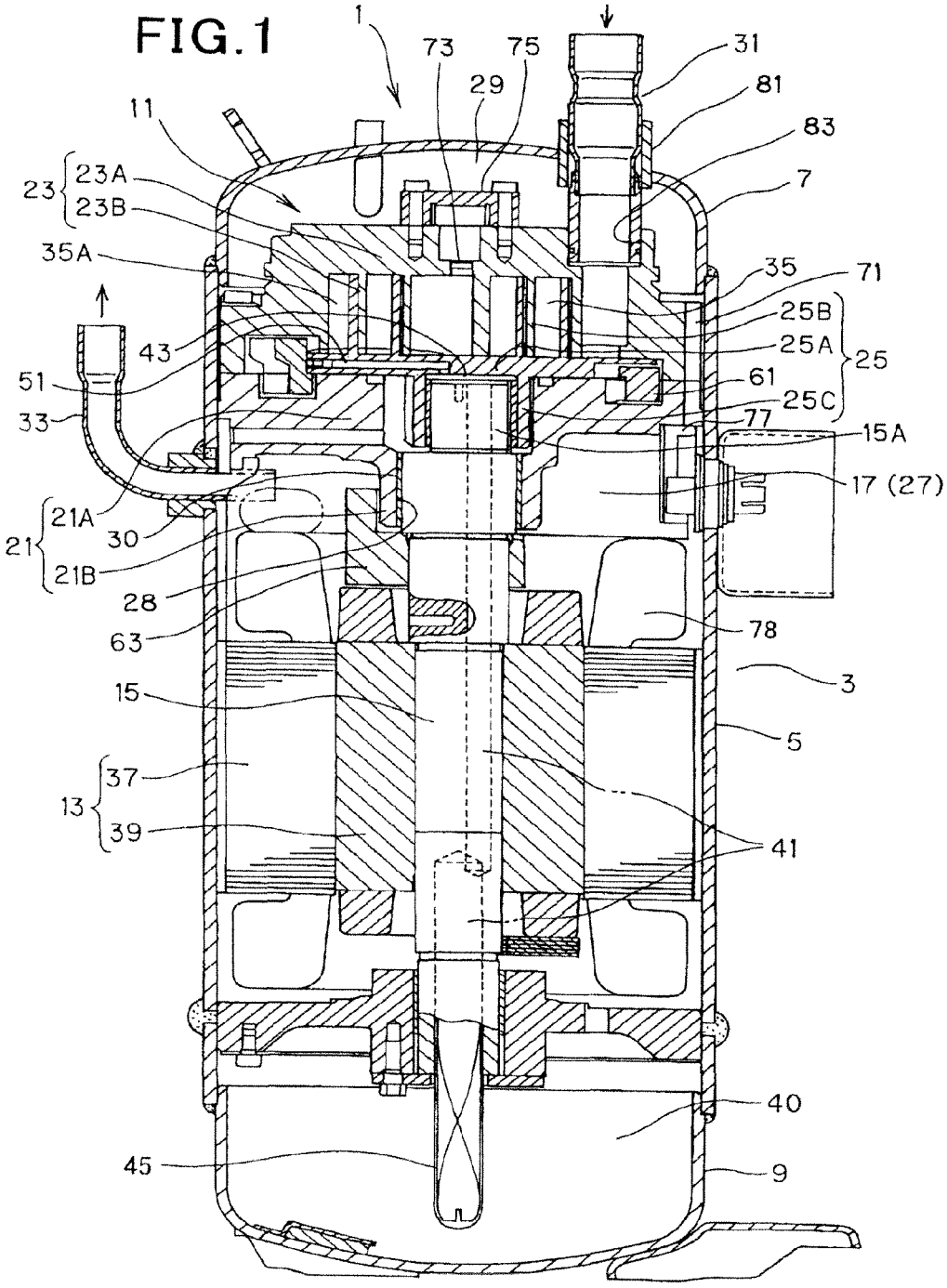
FIG. 1 is an enlarged cross-sectional view showing an embodiment of the present invention.

In FIG. 1, reference numeral 1 represents a scroll type compressor having a high internal pressure. The compressor 1 is connected to a refrigerant circuit (not shown) in which refrigerant is circulated to perform a refrigeration cycle operation, and compresses the refrigerant. The compressor 1 has a hermetically-sealed dome type casing 3 which is designed in an elongated cylindrical shape.

The casing 3 is constructed as a pressure container by a casing main body 5 as a cylindrical body portion having an axis line in the up-and-down direction, a saucer-shaped upper cap 7 which is air-tightly welded and integrally joined to the upper end portion of the casing main body 5 and has an upwardly projecting convex surface, and a saucer-shaped lower cap 7 having a downwardly projecting convex surface, and the inside of the casing 3 is designed to have a cavity.

A scroll compression mechanism 11 for compressing refrigerant, and a driving motor 13 disposed below the scroll compression mechanism 11 are mounted in the casing 3. The scroll compression mechanism 11 and the driving motor 13 are connected to each other through a driving shaft 15 which is disposed so as to extend in the up-and-down direction in the casing 3. A gap space 17 is formed between the scroll compression mechanism 11 and the driving motor 13.

The scroll compression mechanism 11 has a housing 21 as a substantially cylindrical accommodating member which is opened at the upper side thereof and has a bottom, a fixed scroll 23 which is disposed in close contact with the upper surface of the housing 21, and a movable scroll 25 which is disposed between the fixed scroll 23 and the housing 21 and engaged with the fixed scroll 23. The housing 21 is press-fitted in the casing main body 5 over the whole outer peripheral surface thereof in the peripheral direction. The inside of the casing 3 is compartmented into a high pressure space 27 at the lower side of the housing 21 and a discharge space 29 at the upper side of the housing 21, and the respective spaces 27 and 29 intercommunicate with each other through a longitudinal groove (passage) 71 which is formed on the outer peripheries of the housing 21 and the fixed scroll 23 so as to extend longitudinally.

The housing 21 is provided with a housing space 21A in which an eccentric axial portion 15A of the driving shaft 15 is rotated, and a radial bearing portion 21B extending downwardly from the center of the lower surface of the housing 21. Furthermore, the housing 21 is provided with a radial bearing hole 28 penetrating between the lower end surface of the radial bearing portion 21B and the bottom surface of the housing space 21A, and the upper end portion of the driving shaft 15 is rotatably fitted and mounted through the radial bearing 30 in the radial bearing hole 28. A suction pipe 31 for leading the refrigerant in the refrigerant circuit to the scroll compression mechanism 11 penetrates through the upper cap 7 of the casing 3 and is air-tightly fixed to the upper cap 7, and a discharge pipe 33 for discharging the refrigerant in the casing 3 to the outside of the casing 3 penetrates through the casing main body 5 and is air-tightly fixed to the casing main body 5. The suction pipe 31 extends in the up-and-down direction in the discharge space 29, and the inner end portion of the suction pipe 31 penetrates through a suction port (opening) 83 opened to the fixed scroll 23 of the scroll compression mechanism 11, and intercommunicates with the compression chamber 35. Accordingly, the refrigerant is sucked into the compression chamber 35 through the suction pipe 31.

The driving motor 13 has an annular stator 37 fixed to the inner wall surface of the casing 3, and a rotor 39 which is freely rotatably provided inside the stator 37, the motor 13 is constructed by a DC motor, and the movable scroll 25 of the scroll compression mechanism 11 is connected to the rotor 39 through the driving shaft 15.

The lower space 40 at the lower side of the driving motor 13 is kept to a high-pressure state, and oil is stocked at the inner bottom portion of the lower cap 9 corresponding to the lower end portion of the lower space 40. An oil supply path 41 as a part of a high-pressure oil supply unit is formed in the driving shaft 15, the oil supply path 41 intercommunicates with an oil chamber 43 at the back side of the movable scroll 25. A pickup 45 is connected to the lower end of the driving shaft 15, and the pickup 45 scoops up the oil stocked at the inner bottom portion of the lower cap 9. The scooped oil is passed through the oil supply path 41 of the driving shaft 15 and supplied to the oil chamber 43 at the back side of the movable scroll 25, and supplied from the oil chamber 43 to each sliding portion and the compression chamber 35 of the scroll compression mechanism 11 through an intercommunication path 51 provided to the movable scroll 25.

The fixed scroll 23 comprises a mirror plate 23A and a scroll-like (involute type) lap 23*b* formed on the lower surface of the mirror plate 23A. The movable scroll 25 comprises a mirror plate 25A and a scroll-type (involute type) lap 25B formed on the upper surface of the mirror plate 25A. The lap 23B of the fixed scroll 23 and the lap 25B of the movable scroll 25 are engaged with each other, whereby plural compression chambers 35 are formed by both the laps 23B and 25B between the fixed scroll 23 and the movable scroll 25.

The movable scroll 25 is supported through the Oldham's ring 61 by the fixed scroll 23, and a cylindrical boss portion 25C having a bottom is projected from the center portion of the lower surface of the mirror plate 25A. Furthermore, an eccentric shaft portion 15A is provided to the upper end of the driving shaft 15, and the eccentric shaft portion 15A is rotatably fitted in the boss portion 25C of the movable scroll 25.

Furthermore, a counter weight portion 63 is provided to the driving shaft 15 at the lower side of the radial bearing portion 21B of the housing 21 in order to establish dynamic balance with the movable scroll 25, the eccentric shaft portion 15A, etc. The driving shaft 15 rotates while keeping the weight balance by the counter weight portion 63, whereby the movable scroll 25 does not rotate on its axis, but swirls. the compression chamber 35 is configured so that in connection with the swirling of the movable scroll 25, the refrigerant sucked by the suction pipe 31 is compressed due to contraction of the volume between both the laps 23B and 25B.

A discharge hole 73 is provided at the center portion of the fixed scroll 23, and gas refrigerant discharged from the discharge hole 73 is passed through the discharge valve 75 and discharged to the discharge space 29, and flows out into the high-pressure space 27 at the lower side of the housing 21 through a longitudinal groove 71 formed on the respective outer peripheries of the housing 21 and the fixed scroll 23. This high-pressure refrigerant is discharged to the outside of the casing 3 through the discharge pipe 33 provided to the casing main body 5.

A guide member (gas flow deflecting member) 77 is provided to the lower side of the longitudinal groove 71. The guide member 77 deflects the flow direction of the gas refrigerant (which is discharged from the discharge valve 75 to the discharge space 29, passed through the longitudinal groove 71 and flows downwardly) toward a shielding plate and/or in the horizontal direction along the inner surface of the casing main body 5 (casing 3), and also guides the gas refrigerant through a passage between the shielding plate at the upper side of the coil end 78 of the driving motor 13 and the inner surface of the casing main body 5 (casing 3) and then to the discharge pipe 33.

The driving operation of the scroll type compressor 1 described above will be described.

When the driving motor 13 is driven, the rotor 39 rotates relative to the stator 37, and thus the driving shaft 15 rotates. When the driving shaft 15 rotates, the movable scroll 25 of the scroll compression mechanism 11 does not rotate on its axis, but makes only the swirling motion relative to the fixed scroll 23. Accordingly, low-pressure refrigerant is passed through the suction pipe 31, and sucked from the peripheral edge side of the compression chamber 35 into the compression chamber 35, so that this refrigerant is compressed in connection with volume variation of the compression chamber 35. The compressed refrigerant is increased in pressure, passed from the compression chamber 35 to the discharge valve 75, and discharged to the discharge space 29. Further, the refrigerant is passed through the longitudinal groove 71 formed on the respective outer peripheries of the housing 21 and the fixed scroll 23, and then flows out to the high-pressure space at the lower side of the housing 21. Still further, this high-pressure refrigerant is discharged through the discharge pipe 33 provided to the casing main body 5 to the outside of the casing 3. After the refrigerant discharged to the outside of the casing 3 is circulated in the refrigerant circuit (not shown), the refrigerant is sucked through the suction pipe 31 into the compressor 1 again, and compressed in the compressor. The circulation of the refrigerant as described above is repeated.

The flow of oil will be described. Oil stocked in the inner bottom portion of the lower cap of the casing 3 is scooped up by the pickup 45 provided to the lower end of the driving shaft 15, and this oil is passed through an oil path 41 of the driving shaft 15, supplied to an oil chamber 43 at the back side of the movable scroll 25, and then supplied from the oil chamber 43 through an intercommunication path 51 provided to the movable scroll 25 to each of sliding portions of the scroll compressor mechanism 11 and the compression chamber 35.

Figure 2:
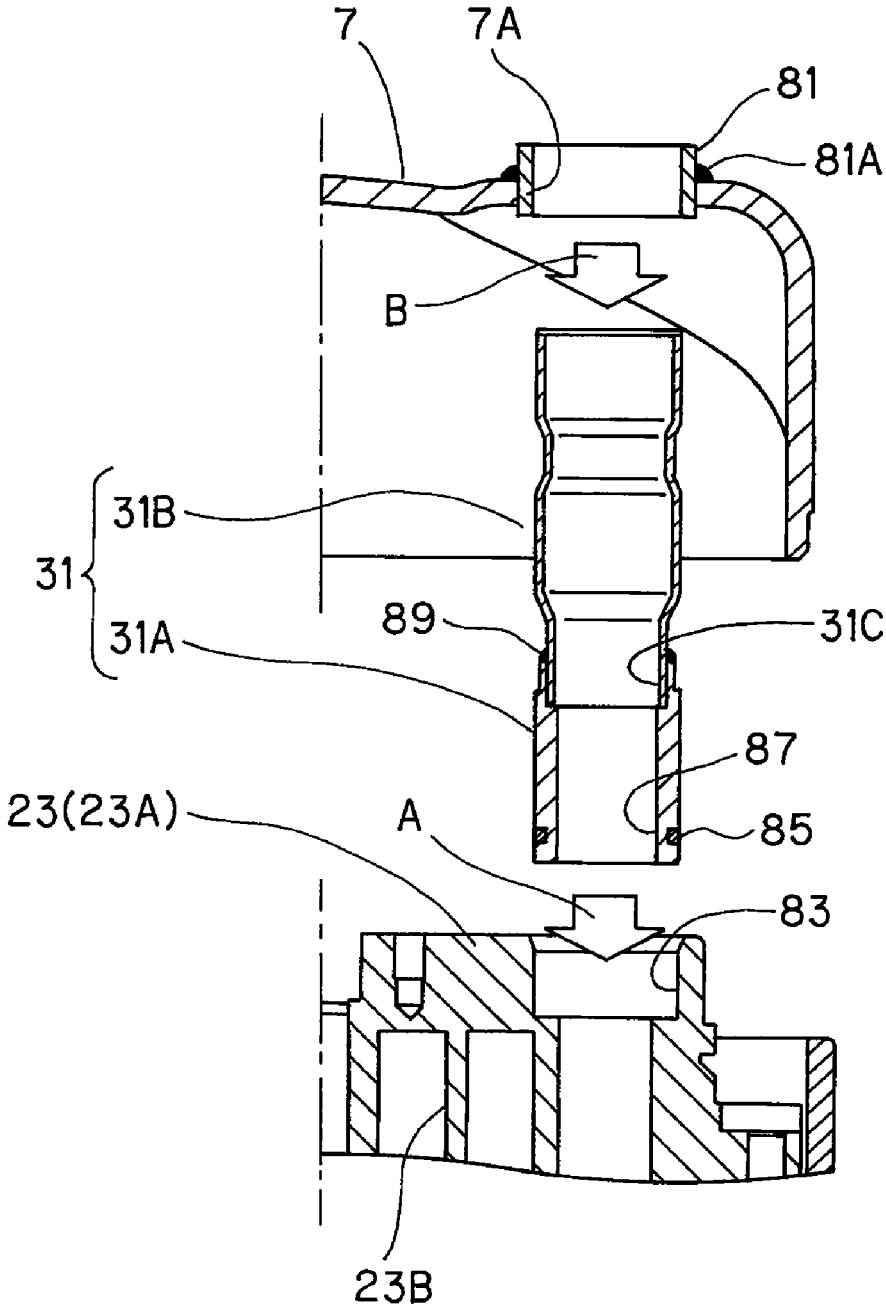
FIG. 2 is an enlarged view showing a suction pipe penetrating through an upper cap.

FIG. 2 is an enlarged view showing the suction pipe 31 penetrating through the upper cap 7.

An annular pipe stand 81 formed of steel (iron) is engagedly fitted in a penetration portion 7A of the upper cap 7 through which the suction pipe 31 penetrates, and welded to the penetration portion 7A by arc welding 81A. The suction pipe 31 penetrating through the upper cap 7 is inserted so as to be engagedly fitted to the inner periphery of the pipe stand 81 (see FIG. 1).

The suction pipe 31 has a cylindrical lower suction member 31A formed of steel, and a cylindrical upper suction member 31B formed of copper. The lower end portion of the lower suction member 31A is fitted in the suction opening 83 of the mirror plate 23A of the fixed scroll 23, and an O-ring groove 87 in which an O ring 85 (in general, the allowable temperature limit of about 150° C.) is engagedly fitted is formed on the outer periphery of the lower end portion of the lower suction member 31A.

Furthermore, the lower end of the upper suction member 31B is reduced in diameter, the diameter-reduced portion 31C is press-fitted to the inner periphery of the upper end portion of the lower suction member 31A and the outer periphery of the diameter-reduced portion 31C is joined to the upper portion of the lower suction member 31A by silver brazing. In this construction, the joint portion based on the brazing 89 is wholly reduced in diameter, the maximum outer diameter of the upper suction member 31B is coincident with the maximum outer diameter of the lower suction member 31A as shown in FIG. 2, and these outer diameters are slightly smaller than the inner diameter of the pipe stand 81.

It is noted that as shown in FIGS. 1-4, a thickness of the lower suction member 31A at a joint portion of the lower suction member and the upper suction member is smaller than the thickness of the lower suction member at the middle portion thereof.

Next, the assembling procedure will be described.

In a first assembling procedure, the O ring 85 is mounted on the lower end of the suction pipe 31, and the O-ring 85 side of the suction pipe 31 is mounted inside the suction opening 83 provided to the fixed scroll 23 as indicated by an arrow A. Subsequently, the upper cap 7 is covered on the suction pipe 31 as indicated by an arrow B. In this case, the suction pipe 31 is made to penetrate through the inner periphery of the pipe stand 81.

In another second assembling procedure, the upper cap 7 is covered on the suction pipe 31. Subsequently, the O ring 85 is mounted on the lower end of the suction pipe 31, and the O-ring 85 side of the suction pipe 31 is made to penetrate through the inner periphery of the pipe stand 81, and mounted inside the suction opening 83 provided to the fixed scroll 23. Therefore, the suction pipe 31 can be afterwards secured after the upper cap 7 is welded.

In this construction, the diameter-reduced portion 31C is designed in a spigot structure with respect to the inner periphery of the upper end portion of the lower suction member 31*a*, and also the joint portion based on the brazing 89 is wholly reduced in diameter, the maximum outer diameter of the upper suction member 31B is coincident with the maximum outer diameter of the lower suction member 31A, and these outer diameters are set to be slightly smaller than the inner diameter of the pipe stand 81. Therefore, the suction pipe 31 can be easily fitted to the inner periphery of the pipe stand 81 described above.

Figure 3:
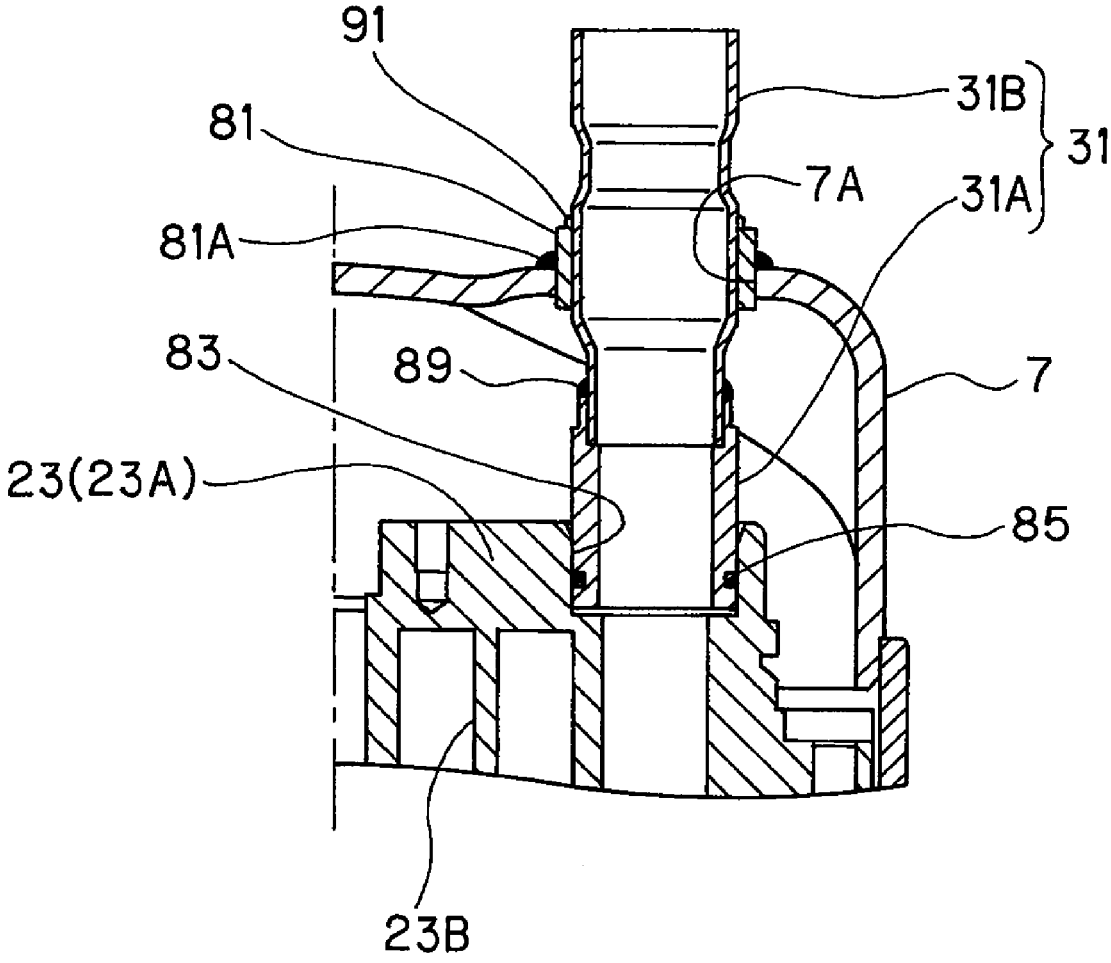
FIG. 3 is a completed chart of an assembly.

FIG. 3 is a completed chart of the assembly.

In this embodiment, after the assembling, the outer peripheries of the upper suction member 31B and the pipe stand 81 are joined to each other by silver brazing 91.

In the case of the brazing 91 work, the joint is performed in short time unlike general welding, and thus increase of temperature of the upper suction member 31B and heat conduction to the lower suction member 31A can be suppressed, thereby suppressing heat transfer to the O ring 85.

In this construction, the suction pipe 31 comprises the upper suction member 31B and the lower suction member 31A. The lower suction member 31A is formed of iron, and thus the thickness of the lower suction member 31A can be designed to be large in thickness. Furthermore, the O-ring groove 87 in which the O ring 85 is engagedly fitted can be processed on the outer periphery of the lower suction member 31A, and the manufacturing cost can be reduced. Furthermore, the upper suction member 31B is formed of copper, and thus the refrigerant pipe (copper pipe) formed of the same material as the upper suction member 31B can be joined to the upper suction member 31B by brazing, and thus the joint work can be easily performed.

Figure 4:
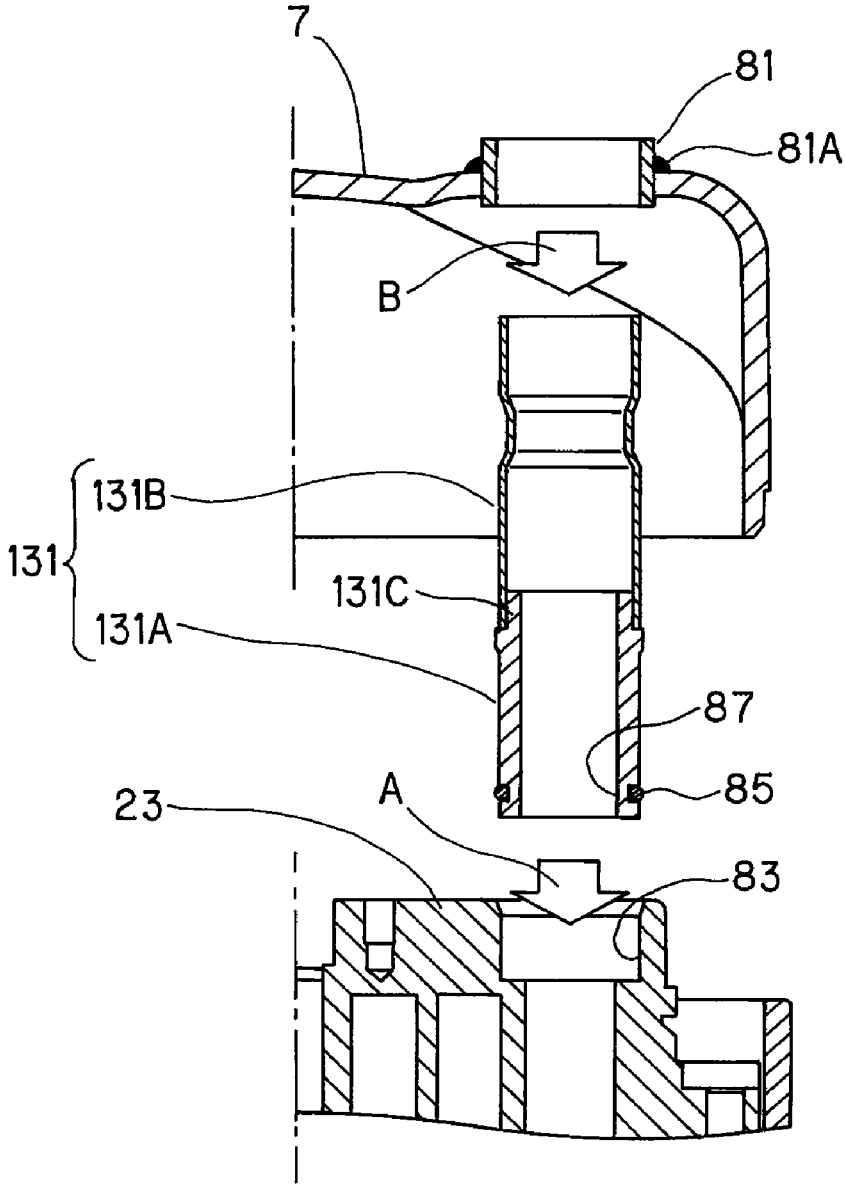
FIG. 4 is a diagram showing another embodiment which corresponds to FIG. 2.

FIG. 4 shows another embodiment. The same parts as shown in FIG. 2 are represented by the same reference numerals, and the description thereof is omitted.

In this embodiment, the suction pipe 131 comprises the upper suction member 131B and the lower suction member 131A, and the lower suction member 131A is formed of iron as in the case of the embodiment described above. Furthermore, the upper suction member 131B is formed of copper. The lower end portion of the upper suction member 131B is not reduced in diameter unlike the above-described embodiment, and a stepped portion 131C at the upper end of the lower suction member 131A is fitted to the inner periphery of the upper suction member 131B.

According to this construction, after the assembling, the outer peripheral portions of the upper suction member 131B and the pipe stand 81 are joined to each other by silver brazing 91.

Accordingly, unlike general welding, the joint can be performed in short time, and thus increase of temperature of the upper suction member 131B and heat conduction to the lower suction member 131A are suppressed, and thus heat transfer to the O ring 85 is suppressed.

In this construction, the suction pipe 131 comprises the upper suction member 131B and the lower suction member 131A, and the lower suction member 131A is formed of iron. Therefore, the lower suction member 131A can be designed to be large in thickness, the O ring groove 87 in which the O ring 85 is fitted can be processed on the outer periphery of the lower suction member 131A, and the manufacturing cost can be reduced. Furthermore, the upper suction member 131B is formed of copper, and thus the refrigerant pipe formed of the same material as the upper suction member 131B can be joined to the upper suction member 131B by brazing, and thus the joint work can be easily performed.

What is claimed is:

1. A scroll type compressor comprising:

a fixed scroll having a suction opening;

a movable scroll;

a hermetically sealed container having an upper cap in which the fixed scroll and the movable scroll are mounted; and a suction pipe that penetrates through the upper cap and is engagedly fitted through an O ring in the suction opening of the fixed scroll at a lower portion thereof, wherein:

the upper cap is provided with a pipe stand formed of iron at a suction-pipe penetrating portion thereof, the suction pipe comprises a lower suction member that is made of iron, is engagedly fitted in the suction opening of the fixed scroll and has an O-ring groove in which the O ring is fitted, and an upper suction member that is made of copper, is joined to the lower suction member by brazing and is engagedly fitted in the pipe stand, the upper suction member and the pipe stand being joined to each other by brazing, the upper suction member has a diameter-reduced portion that is configured to be reduced in an outer diameter at a lower end thereof, and the diameter-reduced portion of the upper suction member is joined to an inner periphery of an upper end portion of the lower suction member by brazing, and a thickness of the lower suction member at a joint portion of the lower suction member and the upper suction member is smaller than the thickness of the lower suction member at the other portion thereof.

2. The scroll type compressor according to claim 1, wherein a maximum outer diameter of the suction pipe is set to be slightly smaller than an inner diameter of the pipe stand so that the suction pipe passes through an inner periphery of the pipe stand.

3. The scroll type compressor according to claim 1, wherein a maximum diameter of the upper suction member and a maximum diameter of the lower suction member are set to be coincident with each other.

4. The scroll type compressor according to claim 1, wherein only the upper suction member is in contact with the pipe stand.

5. The scroll type compressor according to claim 1, wherein brazing materials remain at a brazing portion of the lower suction member and the upper suction member and at a brazing portion of the upper suction member and the pipe stand.

6. A scroll type compressor comprising:

a fixed scroll having a suction opening;

a movable scroll;

a hermetically sealed container having an upper cap in which the fixed scroll and the movable scroll are mounted; and a suction pipe that penetrates through the upper cap and is engagedly fitted through an O ring in the suction opening of the fixed scroll at a lower portion thereof, wherein:

the upper cap is provided with a pipe stand formed of iron at a suction-pipe penetrating portion thereof, the suction pipe comprises a lower suction member that is made of iron, is engagedly fitted in the suction opening of the fixed scroll and has an O-ring groove in which the O ring is fitted, and an upper suction member that is made of copper, is joined to the lower suction member by brazing and is engagedly fitted in the pipe stand, the upper suction member and the pipe stand being joined to each other by brazing, the lower suction member has a diameter-reduced portion that is configured to be reduced in an outer diameter at an upper end thereof, and the diameter-reduced portion of the lower suction member is joined to an inner periphery of a lower end portion of the upper suction member by brazing, and a thickness of the lower suction member at a joint portion of the lower suction member and the upper suction member is smaller than the thickness of the lower suction member at the other portion thereof.

7. The scroll type compressor according to claim 6, wherein a maximum outer diameter of the suction pipe is set to be slightly smaller than an inner diameter of the pipe stand so that the suction pipe passes through an inner periphery of the pipe stand.

8. The scroll type compressor according to claim 6, wherein a maximum diameter of the upper suction member and a maximum diameter of the lower suction member are set to be coincident with each other.

9. The scroll type compressor according to claim 6, wherein only the upper suction member is in contact with the pipe stand.

10. The scroll type compressor according to claim 6, wherein brazing materials remain at a brazing portion of the lower suction member and the upper suction member and at a brazing portion of the upper suction member and the pipe stand.

* * * * *